US007381447B2

(12) United States Patent
Hoersch

(10) Patent No.: US 7,381,447 B2
(45) Date of Patent: Jun. 3, 2008

(54) TEXTILE SUBSTRATE WITH POLYMER FOAM COATING

(75) Inventor: Werner Hoersch, Viersen-Boisheim (DE)

(73) Assignee: Milliken & company, Spartanburg, SC (US)

( * ) Notice: Subject to any disclaimer, the term of this patent is extended or adjusted under 35 U.S.C. 154(b) by 598 days.

(21) Appl. No.: 10/515,456

(22) PCT Filed: Jul. 10, 2003

(86) PCT No.: PCT/EP03/07522

§ 371 (c)(1),
(2), (4) Date: Nov. 22, 2004

(87) PCT Pub. No.: WO2004/007832

PCT Pub. Date: Jan. 22, 2004

(65) Prior Publication Data

US 2005/0181124 A1 Aug. 18, 2005

(30) Foreign Application Priority Data

Jul. 11, 2002 (DE) ..... 102 31 453

(51) Int. Cl.
*B05D 3/12* (2006.01)

(52) U.S. Cl. ..... 427/365; 427/369; 427/371; 427/379; 427/381; 427/389.9; 427/394

(58) Field of Classification Search ..... 427/355, 427/365, 369, 371, 379, 381, 389.9, 394
See application file for complete search history.

(56) References Cited

U.S. PATENT DOCUMENTS

| | | | | |
|---|---|---|---|---|
| 3,751,329 A | | 8/1973 | Fonzi et al. | 161/159 |
| 3,927,229 A | | 12/1975 | Rall et al. | 427/171 |
| 4,061,822 A | * | 12/1977 | Brodnyan et al. | 428/314.2 |
| 4,259,384 A | | 3/1981 | Veiga et al. | 428/97 |
| 4,357,428 A | | 11/1982 | Watson et al. | 521/65 |
| 4,740,407 A | | 4/1988 | Schaefer et al. | 428/87 |

FOREIGN PATENT DOCUMENTS

| | | | |
|---|---|---|---|
| DE | 3433883 | * | 3/1985 |
| DE | 42 41 516 C1 | | 12/1992 |
| DE | 19856412 | | 7/1998 |
| EP | 1 041 191 A2 | | 3/2000 |
| EP | 0 651 090 | | 6/2000 |
| EP | 1 170 416 | | 7/2001 |
| FR | 2246684 | | 9/1974 |
| WO | 94/06852 | | 3/1994 |
| WO | 02/00425 | | 1/2002 |
| WO | 03/004759 | | 1/2003 |

OTHER PUBLICATIONS

Milliken & Company pending U.S. Appl. No. 10/482,557, filed Dec. 30, 2003, inventor Werner Hoersch. Title: "Synthetic suede leather and a process for preparing the same."

* cited by examiner

*Primary Examiner*—Erma Cameron
(74) *Attorney, Agent, or Firm*—Terry T. Moyer; John E. Vick, Jr.

(57) ABSTRACT

The present invention relates to a process for preparing composite textile and composite textile obtainable by this process as well as the use of said composite textile for automotive applications among other things. Said process comprises the following steps: (a) applying a foamed polymer dispersion onto a suede-like textile substrate; (b) drying the composite material of polymer foam and substrate; (c) compacting the polymer foam with the substrate; and (d) heat-treating and/or cross-linking the polymer foam. The composite textile is characterised by a suede-like textile substrate and a polymer foam layer.

12 Claims, No Drawings

TEXTILE SUBSTRATE WITH POLYMER FOAM COATING

The present invention relates to a composite textile such as an imitation leather with a foam layer, a process for the production thereof and the use of said composite textile as a cover in automotive and furniture applications or for garments.

Composite textiles such as imitation leathers or synthetic leathers are generally prepared by a process where first a skin or cover layer of a polyurethane resin is formed on a release paper, followed by application of an adhesive layer to the polyurethane resin and lamination of the composite material thus obtained onto a textile substrate. A "grain-like" structure can be achieved by using uneven release papers. Particularly in case of water-based polyurethane dispersions, however, adhesion between the textile substrate and the polyurethane layer is often insufficient. In order to solve this problem, EP 1 170 416 A2, for example, describes the use of a special adhesive composition on a polyurethane basis. DE 42 41 516 C1, on the other hand, teaches needling a polyurethane foam layer with a non-woven fabric.

In view of this state of the art, it is the object of the present invention to provide a new composite textile which is easy to prepare and has good adhesion between the textile substrate and a polymer foam layer such as a polyurethane foam layer.

It is another object of the present invention to provide a simple process which is suitable for preparing a composite textile such as an imitation leather, but especially for preparing imitation grained leather or imitation Nubuk leather.

On the one hand, these objects of the invention were achieved by providing a composite textile comprising a suede-like textile substrate and a foam layer and, on the other hand, by providing a process for preparing a composite textile, comprising the steps of (a) applying a foamed polymer dispersion onto a suede-like textile substrate;
(b) drying the composite material of polymer foam and substrate;
(c) compacting the polymer foam with the substrate; and
(d) heat-treating and/or cross-linking the polymer foam.

The textile substrate to be used according to the invention has a suede character, i.e. the textile substrate has fibres which, substantially, do not extend in the plane of the textile substrate but stand out in a perpendicular direction (at least 45° in relation to the plane of the textile substrate) or have a pile. Raised woven fabrics, raised warp-knitted fabrics and raised weft-knitted fabrics are preferably used, raised warp-knitted fabrics being especially preferred. Alternatively, it is possible to use a pile fabric such as pile warp-knits, pile weft-knits, pile woven materials or Raschel materials. The raised and pile fabrics preferably have a thickness increased by at least 50%, preferably 70%, vis-a-vis the non-raised material. For example, a warp-knitted or weft-knitted material having a thickness of 0.5 to 0.8 mm is raised to a thickness of at least 1.0 mm, preferably 1.2 to 1.6 mm. In order to obtain an even surface or uniform thickness after raising, raising may be followed by a shearing step. It is also possible to employ an abrasion step instead of or in addition to the raising step.

Non-woven fabrics may also be used as suede-like textile substrates according to the present invention.

The suede-like textile substrates to be used according to the invention also include coated textile substrates, e.g. a textile substrate which has been coated with a foamed or compacted plastic layer and which was subsequently treated to obtain the suede character, for example by sueding.

As a rule, the suede-like textile substrate has a thickness of 1 to 2 mm, preferably 1.2 to 1.6 mm, especially preferably 1.4 to 1.5 mm. Thickness is determined in accordance with DIN EN 12127.

The suede-like substrate to be used in accordance with the invention preferably has a stretch (determined according to DIN 53360) of at least 5%, especially preferred 10 to 25%. The indicated stretch relates to the cross-direction, i.e. stretching along the width of the material. In the direction of the length, stretch is preferably a least 2%, especially preferably 5 to 25%.

The yarns used for the textile substrate are not particularly limited and comprise, among other things, polyester, polyamide and cotton yarns. Polyester yarns are preferred especially for automotive applications while cotton yarns are preferred for garments because they are well tolerated by the skin.

Especially preferred are yarns with fine filaments which preferably have an average count of 2 denier or less, preferably 0.01 to 1.6 denier, especially preferably 0.6 to 1.4 denier.

For example, especially flat or textured polyester yarns with a filament count of 0.6 to about 1.4 denier such as flat or textured polyester filament yarns (e.g. those textured by a false twisting process) are suitable.

Micro-split yarns may also be used as yarns for the textile substrate, the micro-fibres preferably having a count of 0.01 to 1 denier. Micro-split yarn of the so-called "sea-island" type is particularly preferred. The micro-fibres ("islands") may consist of polyester such as polyethylene terephthalate or polyamide such as 6 polyamide or 6,6 polyamide, while the "sea" or the fibre coat is made of a polymer with a solubility or degradability differing from that of the "island" component, for example polyethylene, polystyrene, polyethylene terephthalate modified with sodium sulfoisophthalate and polyethylene glycol. Suitable "sea-island" fibres are described in EP 0 651 090 B1 and EP 1 041 191 A2, for example.

The greige textile substrate is preferably pre-dyed with dispersion dyes before applying the polyurethane foam. For this purpose, disperse dyes for hot-lightfast textiles in automotive applications are preferably used, most preferably the dyes of the TERASIL H® brand made by Ciba and the dyes of the DOROSPERS® brand made by Dohmen. The lightfastness of the disperse dyes used is preferably in the range of these branded dyes. The disperse dye is selected depending on the pigments used, the colour difference between the disperse dye and the pigment preferably being small or the disperse dye and pigment preferably having the same colour tone. In case of a red colouring, for example, both the disperse dye and the pigment will be red. This is advantageous, because it helps avoid a white or grey underground of textile substrate appearing in case of local abrasion of the polyurethane layer. The disperse dye is preferably used in a concentration such that the depth of the colouring with the disperse dye is less than that of the pigment colouring.

Before coating or applying the foamed polymer dispersion, the textile substrate is preferably stretched by 5%, more preferably 10 to 25% and most preferably 10 to 15%. Stretching is carried out along the width of the material, for example from a material width of 1.50 m to one of 1.70 m. As a rule, the substrate is wet during this process. For example, stretching may be carried out during drying after the dyeing step with the disperse dyes with the aid of a tenter frame. In order to achieve sufficient stretching, the textile substrate may be heated. Care should be taken to stay below the fixing temperature of the yarn (which is between 190 and 215° C. for polyesters and polyamides), since otherwise shrinkage to the original size during the drying step is no longer guaranteed, i.e. the "memory effect" of the yarn is lost. The preferred temperature for stretching polyamide or polyester textiles is 100 to 160° C., more preferably 140 to 150° C.

The foamed polymer dispersion to be applied onto the textile substrate is not particularly limited and includes a polyurethane dispersion, a poly(vinyl chloride) (PVC) dispersion, as well as dispersion based on polyacrylates, polystyrene, ethylene-vinyl acetate copolymer, and butadiene copolymers. A foamed polyurethane dispersion is preferably used.

In general, a dispersion of a water-based ionomer polyurethane which may contain a foam stabiliser such as described in WO 94/06852 is used to prepare the foamed polyurethane dispersion. The PU dispersions preferably have a solid content of 30 to 70 wt.-%, especially 32 to 60 wt. %. The term "polyurethane" also includes polyurethane polyureas. A survey of polyurethane (PUR) dispersions and processes therefor may be found in Rosthauser & Nachtkamp, "Waterborne Polyurethanes, Advances in Urethane Science and Technology", vol. 10, pages 121-162 (1987). Suitable dispersions, for example, are also described in "Kunststoffhandbuch", vol. 7, $2^{nd}$ ed., Hanser, pages 24 to 26. PUR dispersions preferably used in the invention include TUBICOAT PRV®, TUBICOAT MB® (manufacturer/supplier: CHT R. Beitlich GmbH, Tubingen) and the curable polymer systems described in WO 94/06852.

Known compounds may be used as foam stabilisers, which are preferably contained in the polymer dispersion during foaming, for example water-soluble fatty acid amides, hydrocarbon sulfonates or saponaceous compounds (fatty acid salts), for example compounds wherein the lipophilic radical contains 12 to 24 carbon atoms; especially alkane sulfonates having 12 to 22 carbon atoms in the hydrocarbon radical, alkyl benzenesulfonates having 14 to 24 carbon atoms in the entire hydrocarbon radical or fatty acid amides or saponaceous fatty acid salts of fatty acids having 12 to 24 carbon atoms. The water-soluble fatty acid amides are preferably fatty acid amides of mono- or di-($C_{2-3}$-alkanol)amines. For example, the saponaceous fatty acid may be an alkali metal salt, amine salt or unsubstituted ammonium salt. Known compounds are generally considered as fatty acids, such as lauric acid, myristic acid, palmitic acid, oleic acid, stearic acid, ricinoleic acid, behenic acid or arachic acid, or technical fatty acids such as coconut fatty acid, tallow fatty acid, soy fatty acid or technical oleic acid as well as hydrogenation products thereof. Especially preferred are unsubstituted ammonium salts of higher saturated fatty acids, especially those having 16 to 24 carbon atoms, primarily stearic acid and hydrogenated tallow fatty acid. The foam stabilisers should be of the kind which decompose neither under foaming conditions nor under application conditions. Suitable ammonium salts are those having a decomposition temperature of ≧90° C., preferably ≧100° C. if desired, the more weakly anionic stabilisers ($B_1$), especially the carboxylic salts or the amides, may be combined with the more strongly anionic surfactants ($B_2$), especially with the above-mentioned sulfonates or preferably fatty alcohol sulfates, advantageously in the form of salts thereof (alkali metal or ammonium salts as mentioned above), for example at a $(B_1)/(B_2)$ weight ratio in the range of 95/5 to 50/50, advantageously 85/15 to 65/35. The product TUBICOAT STABILISATOR RP® (supplier: CHT R. Beitlich GmbH, Tubingen, Germany) may also be used to advantage.

If the dispersion contains a foam stabiliser (such as ammonium stearate), ammonia is preferably added to the dispersion to adjust the pH, preferably in the range of 9 to 11.

In addition, the polymer dispersion usually contains pigments which may be added both before and after foaming, preferably before foaming. Pigments used in the invention are described in Ullmann's Encyclopedia of Industrial Chemistry, 5.sup.th ed., 1992, vol. A20, pages 243 to 413. The pigments used in the invention may be inorganic or organic pigments, preferably organic pigments. The light-fastness of the pigments used should be as high as possible and is preferably in the range of the light-fastness of the pigments BEZAPRINT®, e.g. BEZAPRINT GELB RR® (yellow), BEZAPRINT GRUN B® (green), BEZAPRINT ROSA BW® (pink), BEZAPRINT BRAUN TT® (brown), BENAPRINT VIOLETT FB® (purple), BENAPRINT ROT KGC® (red) and BEZAPRINT BLAU B2G® (blue) (all available from Bezema AG, Montlingen; Switzerland, PIGMATEX GELB (yellow) 2 GNA® (60456), PIGMATEX GLEB (yellow) K® (60455), PIGMATEX FUSHSIA BW® (60416), PIGMATEX MARINE (navy blue) RN® (60434), PIGMATEX BRAUN (brown) R® (60446), PIGMATEX SCHWARZ (black) T® (60402) (all available from SUNChemical, Bad Honnet Germany); OCTER (ochre) E. M. B.® (Ref. 3500), ROT-VIOLETT (red-purple) E. M. B.® (Ref. 4406), BRAUN (brown) E. M. B.® (Ref. 5550) and BLAU (blue) E. M. B.® (Ref. 6500) (all available from RMB NR, Bronheim, Belgium) which are particularly preferred in the invention. The light-fastness values are preferably at least 6, more preferably at least 7 (blue scale; 1 g/kg, see DIN 75 202). the amount of pigments used depends on the intended depth of the colour and is not particularly limited. Preferably, the pigment is used in an amount of up to 10 wt.-% based on the total weight of the polymer dispersion (preferably a PU dispersion), especially preferably in an amount of 0.1 to 5 wt.-%.

The dispersion used for the polymer foam preferably also contains a fixing agent.

Fixing agents preferred for the PU foam to be used according to the invention are aminoplasts or phenolic resins. Suitable aminoplasts or phenolic resins are the well-known commercial products (cf. "Ullmanns Enzyklopädie der technischen Chemie", vol. 7, $4^{th}$ edition, 1974, pages 403 to 422, and "Ullmann's Encyclopedia of Industrial Chemistry, vol. A19, $5^{th}$ ed., 1991, pages 371 to 384.

The melamine-formaldehyde resins are preferred, replacement of 20 mol-% of the melamine with equivalent amounts of urea being possible. Methylolated melamine is preferred, for example bi-, tri- and/or tetramethylol melamine.

The melamine-formaldehyde resins are generally used in powder form or in the form of their concentrated aqueous solutions which have a solids content of 40 to 70 wt. %. For example, TUBICOAT FIXIERER HT® (available from CHT R. Beitlich GmbH, Tubingen) may be used.

Alternatively, fixing agents may be aliphatic or aromatic isocyanates, which may optionally be blocked, as well as polyaziridine.

The dispersion used for the polymer foam preferably also contains a flame retardent.

Suitable flame retardants are antimony trioxide $Sb_2O_3$, antimony pentoxide $Sb_2O_5$, alumina hydrate $Al_2O_3.3H_2O$, zinc borate $Zn(BO_2)_2.2H_2O$ or $2ZnO.(B_2O_3)_3.(H_2O)_{3,5}$, ammonium ortho- or polyphosphate $NH_4H_2PO_4$ or $(NH_4PO_3)_n$ and chloroparaffines.

Especially preferred are the phosphonic acid esters, particularly 5-ethyl-2-methyl-1,3,2-dioxaphosphorinane-5-yl) methyl phosphonate-P-oxide and bis(5-ethyl-2-methyl-1,3,2-dioxaphosphorinane-5-yl)methyl methyl phosphonate-P,P'-dioxide, decabromodiphenylether, hexabromocyclodecane and polyphosphonates such as the product APIROL PP 46® of CHT R. Beitlich GmbH, Tubingen, which is preferably used in an amount of 150 to 250 parts, especially preferably 170 to 190 parts per 1000 parts of the total dispersion.

The polymer dispersion used according to the invention may also contain plasticisers, thickening agents, emulsifiers and/or sun-screens.

Suitable plasticisers are the substances listed in A. K. Doolittle, "The Technology of Solvents and Plasticizers", J. Wiley & Sons. Ltd. Polymer plasticisers are preferably used, for example TUBICOAT MV® (available from CHT R. Beitlich GmbH, Tubingen) and MILLITEX PD-92® (Milliken, U.S.A.). The amount of plasticiser should be as low as possible in order to ensure good abrasion resistance of the final product. The plasticiser is preferably used in an amount of up to 10 wt. % based on the total weight of the composition, more preferably 2 to 7 wt. %.

Suitable thickening agents are common thickening agents such as polyacrylic acids, polyvinyl pyrrolidones or cellulose derivatives such as methyl cellulose or hydroxy ethyl cellulose, e.g. TUBICOAT HEC® (available from CHT R. Beitlich GmbH, Tubingen).

As emulsifiers, the composition used in the invention may contain alkyl sulfates, alkyl benzene sulfonates, dialkyl sulfosuccinates, polyoxyethylene alkyl phenyl ether, polyoxyethylene acyl ester and alkyl aryl polyglycol ether such as TUBICOAT EMULGATOR HF® (available from CHT R. Beitlich GmbH, Tubingen) or fatty acid salts in the form of their alkali or ammonium salts.

Sunscreens such as bis(1,2,2,6,6-pentamethyl-4-piperidyl)sebacate and methyl-1,2,2,6,6-pentamethyl-4-piperidyl sebacate, UV absorbers and sterically hindered phenols may also be included in the composition used according to the invention.

Before application to the textile substrate, the polymer dispersion (e.g. the polyurethane dispersion) is foamed, usually by a mechanical process. This may be carried out in a foam mixing device with application of high shear forces. Foaming in a foam generator by blowing in pressurised air is another alternative. A Stork mixer or a foam processor, e.g. the STORK FP3® foam processor, is preferably used. Foaming is carried out in such a manner that the foam density obtained is preferably 150 to 280 g/l, especially preferably 180 to 220 g/l.

The foam thus obtained is stable, i.e. it does not decompose into a liquid after application, but remains on the textile substrate in the foamed form.

The coating step with the stable foam is carried out using a foam application system by a knife-over-roll coater, an air squeegee, Variopress or, preferably, an open doctor blade with a pressure template (STORK Rotary Screen Coating Unit CFT®). The thickness of the foam after application is usually between 0.4 and 0.8 mm, preferably 0.5 to 0.6 mm.

The composite material of polymer foam and substrate thus obtained is then dried, usually at 80 to 150° C., preferably 100 to 130° C. If the textile substrate has been stretched before application of the polymer foam, it is preferred to carry out the drying step on an aggregate permitting free shrinkage of the composite material of foam and substrate, for example a suspended loop drier or a belt drier (brattice drier).

If the textile substrate has been stretched before application and drying permits free shrinkage of the substrate, said shrinkage process produces a grain-like structure and therefore an imitation leather with a grain-like or Nubuk appearance. If the material was not stretched, a smooth imitation leather is produced. The strength of the graining depends on the pile of the textile substrate: The higher the pile, the stronger the graining; the denser the pile, the finer the graining.

Therefore, the invention provides a process for preparing a grain-type or Nubuk imitation leather which is much simplified in comparison with the common process for preparing a Nubuk leather which comprises a transfer coating from an embossed release paper. In addition, the grain or Nubuk leather imitations obtained by the process of the invention differ from grain-type imitation leather of the prior art insofar as the grains have no repeat pattern (repetition of the grain structure at certain intervals) which is obtained in prior art processes by using an embossing roll.

After that, the polymer foam is compacted with the substrate under high pressure. Such compacting may be carried out on a pressing machine such as a calender in a temperature range of 20 to 180degree. C., preferably 100 to 180.degree. C. and a line pressure of 10 to 60 t (or up to 6 bar), or on a fixing machine such as SUPERCRAB GCP® 1200 (m-tec Maschinenbaugesellschaft mbH, Viersen) at 100 to 160° C., preferably 135 to 140° C. and pressures of 10 to 200 bar, preferably 120 to 180 bar. By this action, foam is compressed (e.g. from a foam thickness of 0.6 mm to 0.2 to 0.4 mm) and adhesion between the foam and the textile substrate ensured.

The use of a fixing machine such as SUPERCRAB GCP® provides a comparatively long contact time of a few seconds (usually 3 to 5 seconds) so as to transfer sufficient heat to the composite material so that part of the polymer foam is heat-treated already so that the process steps of compaction and heat-treatment may be combined.

If sufficient heat-treatment is not achieved during the compacting step, the composite material is heated subsequently, preferably to effect a cross-linking or gelation of the foam, e.g. to a temperature sufficient to ensure adequate condensation of the PU foams or a gelation of the PVC foam, e.g. 140 to 180° C., preferably 170 to 180° C. Such heat-treatment may take place on a tenter frame so that the material is tentered and brought to its final width at the same time. Alternatively, the heat-treatment may be carried out while the composite material is subjected to a mechanical treatment, e.g. in a tumbler.

The process steps (a) to (c) (foam application; drying; compacting) may be repeated. This is preferred in these cases where the first foam coating does not completely cover the surface of the textile substrate, e.g. when coating open-meshed fabrics or non-wovens.

After compaction, the surface may be finished by applying a lacquer or top coating. The lacquer may be based on polyacrylates or PVC. However, a PU coating is particularly preferred, especially for coating PU foams.

A PU top coating applied to a PU foam is especially preferred in cases where the composite textile has to meet high mechanical requirements, for example for use in automotive applications. On the other hand, the top coating reduces the vapour permeability of the composite material of polyurethane foam and substrate which is usually good. Said top coating may be applied in an immersion process (e.g. at a liquor pick-up of 40%) as a meta-stable foam or by means of an air squeegee, foam application being especially preferred with a view to breathing properties and vapour permeability, because a top coating applied in this matter reduces vapour permeability only to a negligible extent.

As a rule, the PU dispersion for the top coating is a water-based PU dispersion which essentially corresponds to the PU dispersion for the PU foam, but does not contain a foam stabiliser. The dry content of the PU dispersion used is preferably 30 to 60 wt. %, especially 32 to 50 wt. %. In comparison with the PU dispersion for the foam layer, the PU dispersion for the top coating is harder, i.e. the polyurethane has a lower content of soft segments (see Ullmann's Encyclopedia of Industrial Chemistry, 5.sup.th ed., 1992, vol. A20, pages 674 to 677). Use of the PU dispersion TUBICOAT PUH® by CHT R. Beitlich GmbH, Tubingen (solids content 40%) is preferred.

If the PU dispersion is applied as a meta-stable foam, it preferably contains the same thickeners as indicated for the PU foam, ammonia and/or a fixing agent as well as a foaming agent. Said foaming agent is usually a surfactant, preferably a non-ionic surfactant such as alkyl amine oxide or an anionic surfactant such as ammonium stearate, for example the foaming agent TUBICOAT AOS® by CHT R. Beitlich GmbH, Tubingen. Before application, the dispersion is foamed to foam weights of 50 to 400 g/l, preferably 50 to 250 g/l.

If the PU dispersion is applied with the aid of an air squeegee, it preferably contains a defoaming agent such as TUBICOAT ENTSCHUMER N® by CHT R. Beitlich GmbH instead of the foaming agent.

If the PU dispersion is applied by an immersion process, it preferably does not contain a foaming agent, but may contain a defoaming agent if the dispersion has the tendency to foam.

In order to improve light-fastness, it may be advantageous to incorporate a sunscreen into the PU dispersion for the top coating.

After application of the top coating, the composite material is preferably dried in a tenter frame at a temperature of 140 to 190° C., more preferably 170 to 180° C. Crosslinking takes place during this drying step.

After that, the composite material is preferably subjected to mechanical treatment in a tumbler which makes the material softer and any grain pattern present more pronounced. This treatment is preferably carried out at an excess pressure of up to 6 bar, preferably a pressure of 3 to 4 bar, and elevated temperatures, preferably 110 to 160° C. In addition, it is preferred to conduct such treatment under a defined humidity, e.g. 3 to 10%.

After that, a tentering and drying step may be carried out on a commercial tenter frame.

The invention also comprises a composite textile obtainable by the process described above.

The composite textile of the invention—which may have the appearance and feel of leather, i.e. is an imitation leather—is characterised by a suede-like textile substrate and a polymer foam layer, preferably a polyurethane foam layer. The thickness of the composite textile is usually 1 to 2 mm, which essentially corresponds to the thickness of the suede-like textile substrate (thickness of the textile substrate preferably 1 to 1.8 mm). As discussed above, the composite textile is also characterised by the fact that any grains present do not have a repeat pattern. This is in contrast to known grained leathers which have a repeat pattern defined by the circumference of the embossing roll used in the embossing process. The maximum repeat pattern of known grained leather is about 1 m.

The composite textile, (e.g. imitation leather) of the invention is particularly well suited for internal automotive applications, to example for dashboards, side-panel liners, rear shelves, roof liners, boot liners and seats as well as for the production of upholstered furniture, especially as covers for easy chairs, couches and chairs. In addition, it is suitable for garments (especially outer garments) and for use in the shoe industry as top material and lining.

EXAMPLE

| | |
|---|---|
| Starting material: | 3-bar warp-knitted fabric |
| Guide bar 1: | 45f32T-611 flat, 33.4% |
| Guide bar 2: | 45f32T-611 flat, 45.7% (alternatively, 83f136 with micrell texture |
| Guide bar 3: | 50f20T-610 flat 20.9% |

All yarns are greige yarns, i.e. of an untreated white colour.

Path of treatment:

1. Pre-sueding on several tambours
2. Sueding and shearing
3. Dyeing with selected disperse dyes as formulated
4. Drying The textile substrate is now ready for coating (weight per unit area 250 g/m$^2$).

After dyeing, the substrate is dried at 150° C. with the aid of a tenter frame and stretched (by 10% of the subsequent width of the material).

As a next step, the pre-dyed material is coated with the following pre-foamed PU dispersion (in wt.-%):

| | | |
|---|---|---|
| TUBICOAT PRV ® | 950 parts | CHT, Tübingen |
| TUBICOAT FIXING AGENT H.T. ® | 50 parts | CHT, Tübingen |
| TUBICOAT STABILISATOR RP ® | 5 parts | CHT, Tübingen |
| Ammonia (25%) | 3 parts | Any product suitable |
| APIROL PP46 ® | 180 parts | CHT, Tübingen |
| BEZAPRINT SCHWARZ DW ® | 40 parts | Bezema, CH-Montlingen |
| BEZAPRINT BLAU BT ® | 5 parts | Bezema, CH-Montlingen |
| BEZAPRINT ROSA BW ® | 0.5 parts | Bezema, CH-Montlingen |

Viscosity (Haake, VT02) 15 20 dPas (25° C.), pH value 9 to 10.

The coating process with a stable foam is carried out using a foam processor and a foam application system with an open doctor blade with a pressure template (STORK Rotary Screen Coating UNIT CFT®).

After that drying was carried out at 100 to 110° C. in a belt dryer in a first field at 110° C., a second field at 120° C. and then a third field at 130° C.

In the next process step, the material is simultaneously exposed to a high pressure and a high temperature on a SUPERCRAB GCP® 1200 (m-tec GmbH) at 140° C. (right-hand side against silicone rolls) and a pressure of 150 bar in order to compact the substrate and the PU.

Tentering and condensing is carried out on a tenter frame at 175° C. and the material brought to its final width.

Three different top coatings were alternatively applied to the composite material of polyurethane foam and substrate:

a) Top coating by an immersion process: 100 to 300 g/l TUBICOAT PUH® plus 2% TUBICOAT fixing agent HT® via foulard are applied (liquor pick-up 40%).

b) Top coating by foam application: the following dispersion was foamed to 50 to 250 g/l and then applied with a foam applicator (parts by weight):

| | | |
|---|---|---|
| TUBICOAT PUH ® | 950 parts | CHT, Tübingen |
| TUBICOAT THICKENING AGENT HEC ® | 1.5 parts | CHT, Tübingen |
| Ammonia (25%) | 3 parts | Any product suitable |
| TUBICOAT AOS ® | 40 parts | CHT, Tübingen |
| TUBICOAT FIXING AGENT H.T. ® | 20 parts | CHT, Tübingen |

c) Top coating via an air squeegee: The following dispersion was applied with the aid of an air squeegee (parts by weight):

| | | |
|---|---|---|
| TUBICOAT PUH ® | 950 parts | CHT, Tübingen |
| Tubicoat defoaming agent | 5 parts | CHT, Tübingen |
| TUBICOAT FIXING AGENT H.T. ® | 10 parts | Any product suitable |
| TUBICOAT THICKENING AGENT LP ® | 20 parts | CHT, Tübingen |

Drying and condensation is then carried out on a tenter frame at 175° C. followed by processing in a tumbler (Thies, Coesfeld) under a pressure of 3 to 4 bar and approx. 6% humidity, 140° C. and 600 rpm.

The process is completed by a tentering and drying process on a commercial tenter frame.

Laboratory results achieved:

X1200 exposure test (Ford method, FLTMBO 150-02): Grade 4

Abrasion Resistance:

The sample material passed the test with an intact coating up to 60,000 Martindale abrasion cycles.

The invention claimed is:

1. A process for preparing a polyurethane-containing composite textile of imitation leather, the process comprising the steps of;

(a) providing a knitted or woven textile substrate having a length and a width;

(b) stretching the knitted or woven textile substrate along its width, the textile substrate having fibers which do not extend in the plane of the textile substrate but stand out at least 45° in relation to said plane, or having a pile, said stretching being effective to increase the width dimension of said substrate by at least 5%;

(c) applying a foamed polyurethane dispersion onto the textile substrate to form a composite material;

(d) drying the composite material, thereby facilitating free shrinkage of the composite material;

(e) compacting the composite material; and (f) condensing the composite material.

2. A process according to claim 1, comprising the additional step of applying a polyurethane top coating to the composite material following the compacting step (e).

3. A process according to claim 1, wherein the textile substrate has a thickness of at least 1 mm.

4. A process according to claim 1, wherein the textile substrate is a warp-knitted fabric.

5. A process according to claim 1, wherein the textile substrate is pre-dyed with disperse dyestuffs.

6. A process according to claim 1, wherein the foamed polyurethane dispersion contains pigment during application.

7. A process according to claim 1, comprising the additional steps of:

(g) providing a tumble process following condensation; and (h) applying a top coating or lacquer.

8. A process according to claim 1, wherein an application of a top coating is placed upon the composite material following the step of condensing the composite material.

9. A process according to claim 8, wherein the top coating is a lacquer.

10. The process according to claim 8, wherein the top coating is a polyurethane.

11. The process according to claim 8, wherein the composite is dried on a tenter after the application of a top coating.

12. The process according to claim 7, wherein the tumble process comprises mechanical treatment in a tumbler.

* * * * *